US006870873B2

(12) United States Patent
Lyons et al.

(10) Patent No.: US 6,870,873 B2
(45) Date of Patent: Mar. 22, 2005

(54) DEVICE FOR IMPROVED SLAG RETENTION IN WATER COOLED FURNACE ELEMENTS

(75) Inventors: Kelly Gene Lyons, Brentwood, TN (US); Mark Thomas Arthur, Franklin, TN (US)

(73) Assignee: Systems Spray-Cooled, Inc., Nashville, TN (US)

( * ) Notice: Subject to any disclaimer, the term of this patent is extended or adjusted under 35 U.S.C. 154(b) by 0 days.

(21) Appl. No.: 10/446,956

(22) Filed: May 28, 2003

(65) Prior Publication Data

US 2004/0240510 A1 Dec. 2, 2004

(51) Int. Cl.[7] ..... F27D 1/00; F27D 1/12
(52) U.S. Cl. ..... 373/71; 373/76
(58) Field of Search ..... 373/71–77; 266/190–193, 266/241, 280, 286

(56) References Cited

U.S. PATENT DOCUMENTS 4,011,651 A 3/1977 Bradbury et al.
4,162,061 A * 7/1979 Buhler et al. ..... 373/76
4,304,396 A 12/1981 Udoh
4,437,651 A * 3/1984 Cordier et al. ..... 266/193
4,559,011 A 12/1985 Gritsuk et al.
4,637,034 A 1/1987 Grageda
4,715,042 A 12/1987 Heggart et al.
4,787,605 A 11/1988 Kaptein
4,815,096 A 3/1989 Burwell
4,849,987 A 7/1989 Miner et al.
4,903,640 A 2/1990 Howard
5,327,453 A 7/1994 Arthur et al.
5,426,664 A * 6/1995 Grove ..... 373/75
6,059,028 A 5/2000 Kincheloe et al.
6,330,269 B1 * 12/2001 Manasek et al. ..... 373/71
6,404,799 B1 * 6/2002 Mori et al. ..... 373/71
2003/0005314 A1 1/2003 Manasek et al.

FOREIGN PATENT DOCUMENTS

EP 0 519 553 A1 6/1992

* cited by examiner

*Primary Examiner*—Tu Hoang
(74) *Attorney, Agent, or Firm*—Waddey & Patterson, P.C.; James R. Cartiglia

(57) ABSTRACT

A slag retainer for protecting a water-cooled furnace element through the use of an elongate metal member which extends from inside the furnace, through the furnace wall and into the cooling water of the furnace element so that the insert can be continuously cooled and collected and retain a protective mass of slag.

11 Claims, 10 Drawing Sheets

DEVICE FOR IMPROVED SLAG RETENTION IN WATER COOLED FURNACE ELEMENTS

BACKGROUND OF THE INVENTION

This invention relates to water-cooled furnace systems, e.g. electric arc furnace systems and more particularly to slag retaining means in the form of an elongate metal insert extending from inside the furnace vessel through the wall of a water-cooled furnace wall section and into the water contained therein.

Spray cooled electric furnace systems of the type disclosed in U.S. Pat. Nos. 4,715,042, 4,815,096 and 4,849,987 involve the spray cooling of furnace closure elements, e.g. roofs and side walls, which are unitary, i.e. formed into one piece, and have a generally cylindrical or oval in the case of a furnace side wall or other closure element. Due to the geometry of furnace electrodes and oxygen lances, variations in heating of the furnace, and the like, regions of the surface of a spray cooled closure element can be exposed to unusually high temperature and become thermally stressed with the risk of failure at such regions.

A furnace system as above described is typically made of steel, aluminum, aluminum base alloys, copper, copper base alloys and metals having similar thermal characteristics and have metal slag retainers, made from the aforesaid metals attached to the furnace side of the metal closure elements. These slag retainers, typically cup-shaped to aid in slag retention being unprotected from the high furnace temperatures, have a relatively short life due to overheating and oxidation. The use of the more oxidation resistant and thermally conductive materials in the slag retainers would result in substantially higher cost without commensurate benefit.

It is therefore an object of the present invention to provide improved slag retainers for a water-cooled furnace closure element with enhanced slag retention to reduce damaging heat.

SUMMARY OF THE INVENTION

Slag retention means for a furnace containing molten metal and slag to enable cooling protection at a thermally stressed wall section of a water-cooled closure element of the furnace is provided in the form of an elongate metal insert which extends from inside the furnace through the stressed wall section and into the cooling water whereby the metal insert is continuously and directly cooled and collects slag on the portion extending into the furnace which serves to reduce the thermal stress on the water-cooled closure element. The slag retention means is suitably formed of steel, aluminum, aluminum base alloys, copper, copper base alloys and metals with similar thermal characteristics.

DETAILED DESCRIPTION OF THE INVENTION

Figure 1:
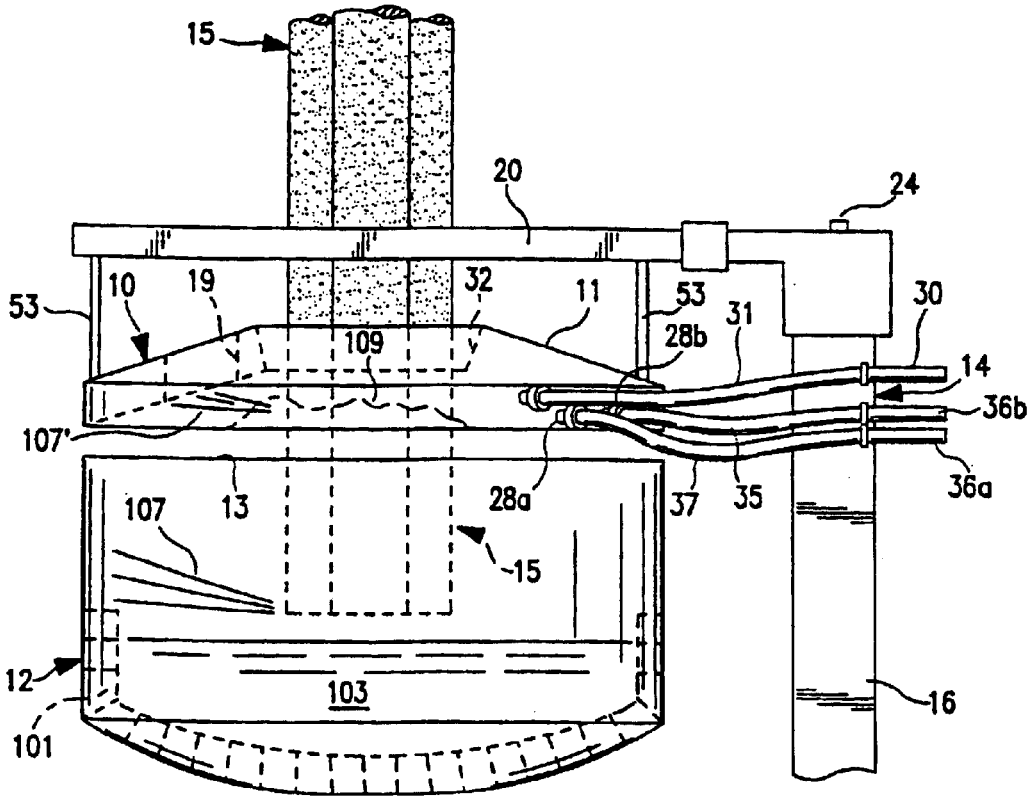
FIG. 1 PRIOR ART
FIG. 1 is a side elevational view of a typical electric furnace installation showing a furnace vessel, a furnace roof in a raised position over the furnace vessel and a mast supporting structure for the roof.
Figure 2:
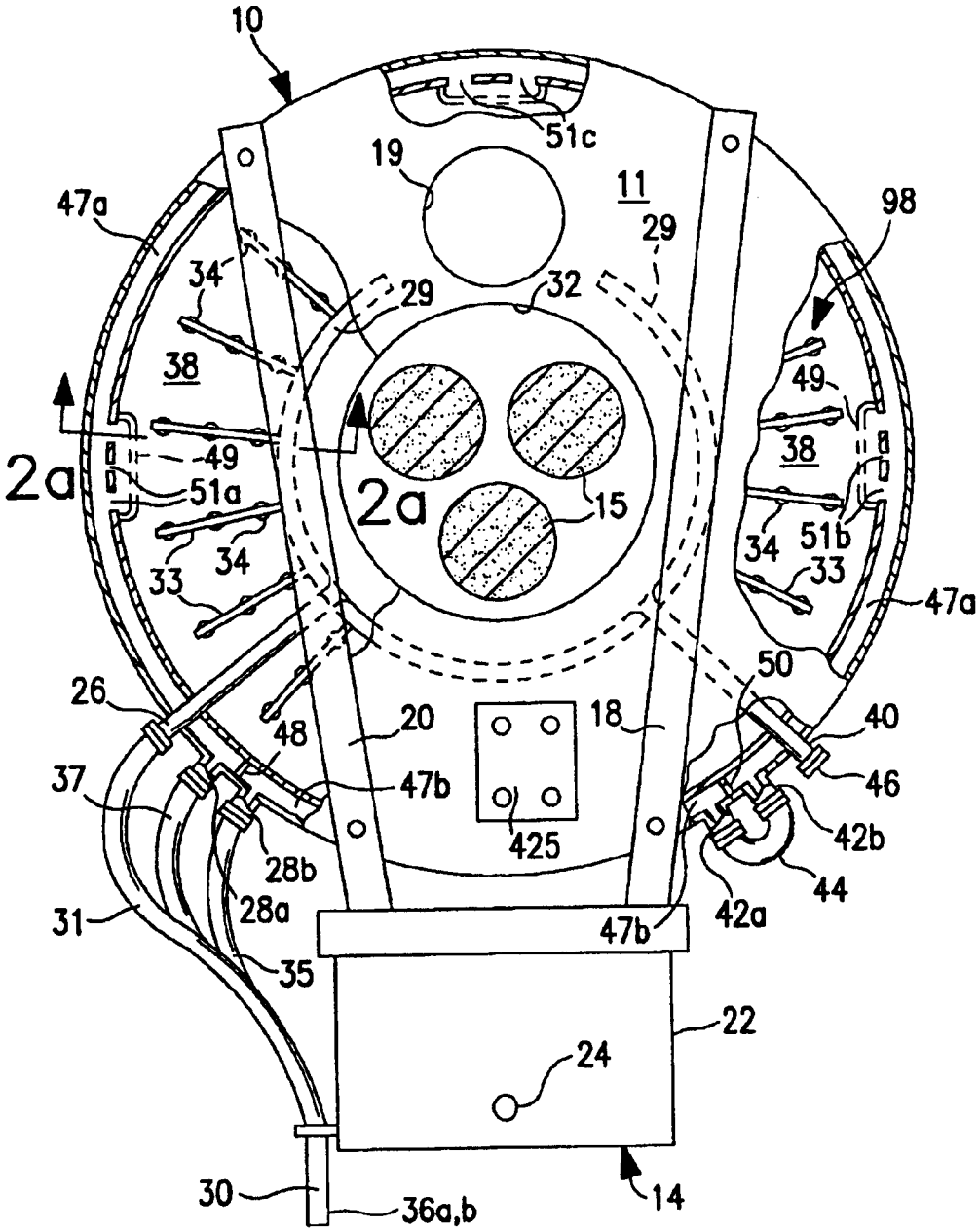
FIG. 2 PRIOR ART
FIG. 2 is a top plan view, partially cut away and partially in section, of a spray cooled furnace roof of FIG. 1.
Figure 3:
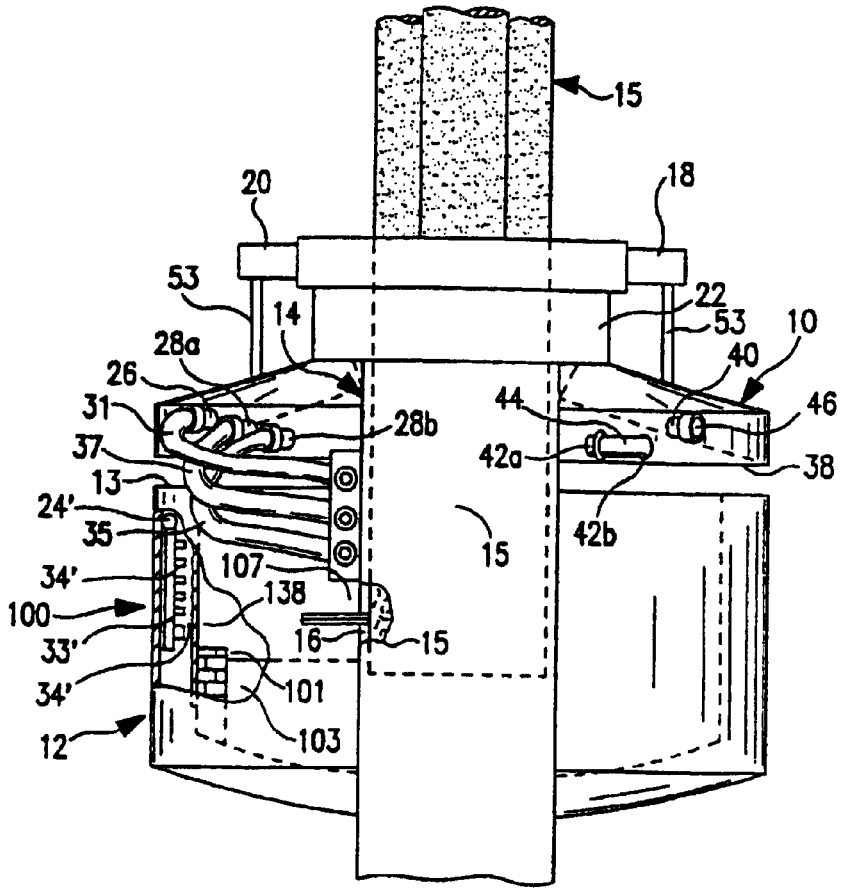
FIG. 3 PRIOR ART
FIG. 3 is an end elevational view, partly in section, of the electric furnace installation of FIG. 1 also showing the refractory lined molten metal-containing portion of the furnace vessel and furnace side wall spray cooling components similar to those of the furnace roof of FIG. 2*a;*

FIGS. 1–3*a* illustrate, by way of example, a spray cooled electric furnace installation as used for steel making, although the spray cooled furnace roof system can be utilized in any type of molten material processing vessel containing molten material, including slag. FIGS. 1, 2 and 3 illustrate a spray cooled electric arc furnace installation of the type shown in U.S. Pat. No. 4,849,987—F. H. Miner and A. M. Siffer, in side, top and end views, respectively. The circular water-cooled furnace roof 10 is shown being supported by a furnace mast structure 14 in a slightly raised position directly over the rim 13 of electric arc furnace vessel 12. As shown in FIGS. 1 and 2, the roof 10 is a unitary, integral i.e. one-piece closure component of frusto-conical shape which is attached by chains, cables or other roof lift members 53 to mast arms 18 and 20 which extend horizontally and spread outward from mast support 22. Mast support 22 is able to pivot around point 24 on the upper portion of vertical mast post 16 to swing roof 10 horizontally to the side to expose the open top of furnace vessel 12 during charging or loading of the furnace, and at other appropriate times during or after furnace operation. Electrodes 15 are shown extending into opening 32 from a position above roof 10. During operation of the furnace, electrodes 15 are lowered through electrode ports of a delta in the central roof opening 32 into the furnace interior to provide the electric arc-generated heat to melt the charge. Exhaust port 19 permits removal of fumes generated from the furnace interior during operation.

Figure 5A:
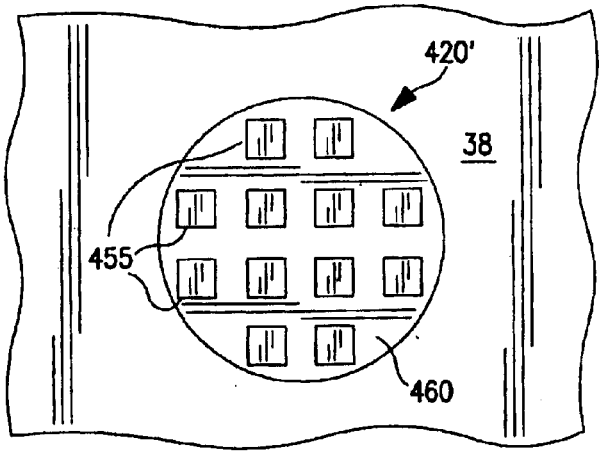
FIGS. 5, 5*a*, 6, 6*a*, 7, 7*a*, 8, 8*a*, 9, 9*a* show specific preferred embodiment of the present invention installed through the hot face of a water-cooled furnace component.
Figure 5:
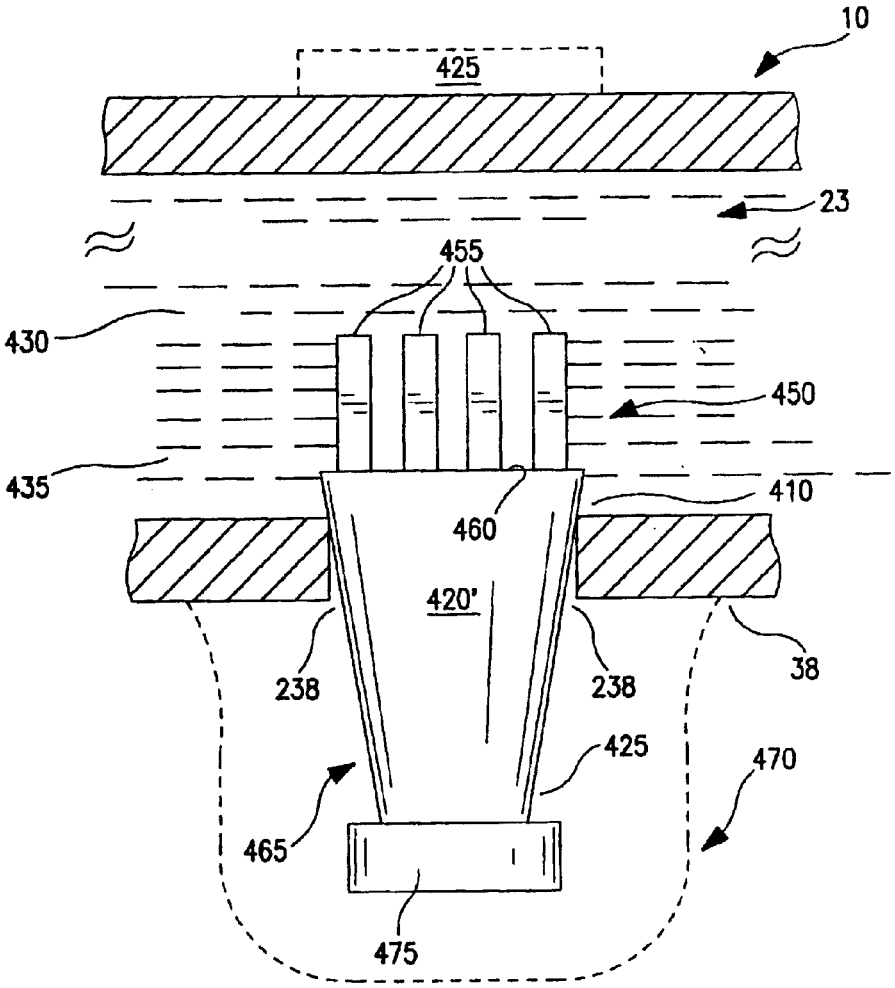

The furnace system is mounted on trunnions or other means (not shown) to permit the vessel 12 to the tilted in either direction to pour off slag and molten steel. The furnace roof system shown in FIGS. 1, 2 and 5 is set up to be used as a left-handed system whereby the mast 14 may pick up the unitary, one-piece roof 10 and swing it horizontally in a counterclockwise manner (as seen from above) clear of the furnace rim 13 to expose the furnace interior although this is not essential to the present invention which is applicable to all types of electric furnaces or other furnaces which include water-cooled surfaces. To prevent excessive heat buildup on the lower metal surface 38 of roof 10 as it is exposed to the interior of furnace vessel 12, a roof cooling system 98 is incorporated therein. A similar cooling system is shown at 100 in FIG. 3 and FIG. 3*a* for a furnace sidewall 138 in the form of a unitary, one-piece cylindrically shaped shell. Refractory liner 101 below cooling system 100 contains a body of molten metal 103. The cooling system utilizes a fluid coolant such as water or some other suitable liquid to cool the furnace roof sidewall or other unitary closure element.

The systems described in the aforementioned U.S. Pat. No. 4,715,042, U.S. Pat. No. 4,815,096 and U.S. Pat. No. 4,849,987, the disclosure of which is incorporated herein by reference are preferred, although other cooling systems can readily take advantage of the present invention. Coolant inlet pipe 26 and outlet pipes 28*a* and 28*b* comprise the coolant connection means the illustrated left-handed configured furnace roof system. An external circulation system (not shown) utilizes coolant supply pipe 30 and coolant drain pipes 36*a* and 36*b*, respectively, to supply coolant to and drain coolant from the coolant connection means of roof 10 as shown in FIGS. 1–3. The coolant circulation system normally comprises a coolant supply system and a coolant collection system, and may also include coolant re-circulation means.

Attached to coolant supply pipe 30 is flexible coolant supply hose 31 which is attached by quick release coupling or other means to coolant inlet pipe 26 on the periphery of furnace roof 10. As shown besting FIGS. 2 and 2*a*, inlet 26 leads to an inlet manifold 29 which extends around central delta opening 32 in the un-pressurized interior of roof 10 or inlet manifold 29' which extends around furnace 13 as shown in FIG. 3. Branching radially outward from manifold 29 in a spoke like pattern is a plurality of spray header pipes 33 to deliver the coolant to the various sections of the roof interior 23. Protruding downward from various points on each header 33 is a plurality of spray nozzles 34 which direct coolant in a spray or fine droplet pattern to the upper side of roof lower panels 38, which slope gradually downwardly from center portion of the roof to the periphery.

After being sprayed onto the roof lower panels 38, the spent coolant drains by gravity outwardly along the top of roof lower panels 38 and passes through drain inlets or openings 51*a*, 51*b* and 51*c* in a drain system. The drain system shown is a manifold which is made of rectangular cross section tubing or the like divided into segments 47*a* and 47*b*. A similar drain system (not shown) is provided for furnace 13. As seen in FIG. 2, drain openings 51*a* and 51*b* are on opposite sides of the roof. The drain manifold takes the form of a closed channel extending around the interior of the roof periphery at or below the level of roof lower panels 38 and is separated by partitions or wall 48 and 50 into separate draining segments 47*a* and 47*b*. Drain manifold segments 47*a* connects drain openings 51*a*, 51*b* and 51*c* with coolant outlet pipe 28*a*. Drain manifold segment 47*b* is in full communication with segment 47*a* via connection means 44 and connects drain openings 51*a*, 51*b* and 51*c* with coolant outlet pipe 28*b*. Flexible coolant drain hose 37 connects outlet 28*a* to coolant drain pipe 36*a* while flexible coolant drain hose 35 connects outlet 28*b* and coolant drain pipe 36*b*. Quick release or other coupling means may be used to connect the hoses and pipes. The coolant collection means to which coolant drain pipes 36*a* and 36*b* are connected will preferably utilize jet or other pump means to quickly and efficiently drain the coolant from the roof 10. Any suitable other means to assist draining of the coolant from the roof or furnace shell may also be utilized.

Although they are not used as such during left-handed operation of the furnace roof system as shown in FIGS. 1, 2, 2*a* and 5, a second coolant connection means which may be used in a right-handed installation of roof 10 is provided. This second or right-handed coolant connection means comprises coolant inlet 40 and coolant outlet 42. The left and right-handed coolant connection means are on opposite sides of roof 10 relative to a line passing through mast pivot point 24 and the center of the roof, and lie in adjacent quadrants of the roof. As with left-handed coolant inlet pipe 26, right-handed coolant inlet pipe 40 is connected to inlet manifold 29. As with the left-handed coolant outlet 28, right-handed coolant outlet 42 includes separate outlet pipes 42*a* and 42*b* which communicate with the separate segments 47*a* and 47*b* of the coolant drain manifold which are split by partition 50. To prevent coolant from escaping through the right-handed coolant connection means during installation of roof 10 in a left-handed system, the present invention also provides for capping means to seal the individual roof coolant inlets and outlets. A cap 46 may be secured over the opening to coolant inlet 40. A removable U-shaped conduit or pipe connector 44 connects and seals the separate coolant outlet openings 42*a* and 42*b* to prevent leakage from the roof and to provide for continuity of flow between drain manifold segments 47*a* and 47*b* around partition 50. Where the draining coolant is under suction, connector 44 also prevents atmospheric leakage into the drain manifold sections.

During operation of the furnace roof as installed in a left-handed furnace roof system, coolant would enter from coolant circulation means through coolant pipe 30, through hose 31, and into coolant inlet 26 whereupon it would be distributed around the interior of the roof by inlet manifold 29. Coolant inlet 40, also connected to inlet manifold 29, is reserved for right-handed installation use and therefore would be sealed off by cap 46. After coolant is sprayed from nozzles 34 on spray headers 33 to cool the roof bottom 38, the coolant is collected and received through drain openings 51*a*, 51*b* and 51*c* into the drain manifold extending around the periphery of the roof 10 and exits through coolant outlet 28. As seen in FIG. 2, coolant draining through openings 51*a*, 51*b* and 51*c* on segment 47*a* of the drain manifold many exit the roof directly through coolant outlet 28*a*, through outlet hose 37 and into drain outlet pipe 36*a* before being recovered by the coolant collection means. Coolant draining through openings 51*a*, 51*b* and 51*c* on segment 47*a* of the drain manifold may also travel through coolant outlet 42*b*, through U-shaped connector 44, and back through coolant outlet 42*a* into manifold segment 47*b* in order to pass around partition 50. The coolant would then drain from drain manifold segment 47*b* through coolant outlet 28*b*, outlet hose 35 and through drain pipe 36*b* to the coolant collection means. Right-handed coolant outlet 42 is not utilized to directly drain coolant from the roof, but is made part of the draining circuit through the use of U-shaped connector 44. Upon being drained from the roof, the coolant may either be discharged elsewhere or may be re-circulated back into the roof by the coolant system. Left-handed coolant connection means 26 and 28 are positioned on roof 10 closely adjacent to the location of mast structure 14 to minimize hose length. Viewing the mast structure 14 as being located at a 6 o'clock position, the left-handed coolant connection means is located at a 7 to 8 o'clock position.

Figure 3A:
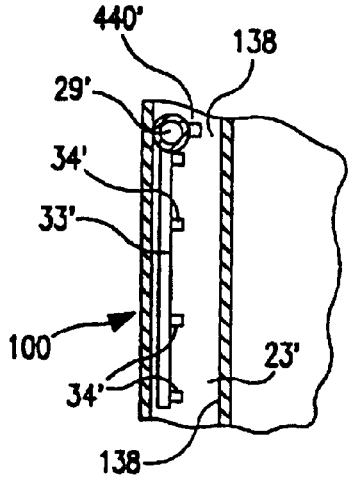
FIG. 3a PRIOR ART
FIG. 3*a* is an enlarged partial view of the sectional portion of FIG. 3.

The spray cooled system as above described can be utilized with molten material furnaces in roof systems, as above described or with other components such as metal furnace sidewalls, as shown at 100 in FIG. 3 and FIG. 3*a* and other spray cooled furnace system components such as metal ducts for carrying gases from the furnace.

Figure 2A:
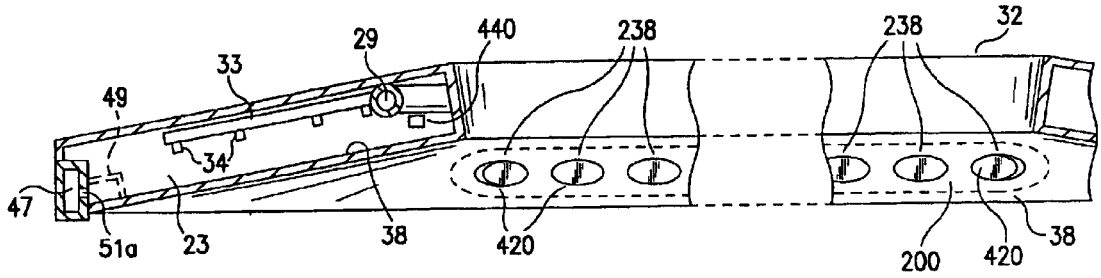
FIG. 2*a* is a fragmented cross sectional view along the line 2*a*—2*a* of FIG. 2 also showing partial elevation view of the furnace roof and, in phantom, by way of example, a thermally stressed region and a schematic representation of the incorporation of thermally conductive, slag retaining inserts of the present invention.

In the operation of a furnace system as above described, a spray cooled unitary closure element, such as the frustoconically shaped metal roof inner plate 38 shown in FIGS. 2, 2*a* and 3, or cylindrically shaped metal sidewall unitary closure element inner plate 138, shown in FIGS. 3, 3*a* may be exposed to significantly increased amounts of radiant thermal energy from the arc or flame within the furnace above the body of molten metal 103, as indicated at 107', when the electrodes are positioned above a flat molten metal batch, or as indicated at 107, when the electrodes begin to bore-in to a scrap charge 109. These conditions result in higher temperatures and thermal stress at one site, or region, as compared to other portions thereof. This circumstance can occur due to the relative position of the furnace electrodes, oxygen lances, or other non-uniform furnace operating conditions. Such a high thermal stress circumstance is exemplarily represented at region 200 in FIG. 4, which is exposed to increased radiant energy 107' amd FIG. 2*a* for spray cooled inner roof plate closure element 38, but is also applicable to a sidewall plate unitary closure element 138 as indicated in FIG. 3. The highly heat stressed condition, or region 200 can be detected by routine temperature monitoring, or by visual inspection, or during shut-down which may reveal a slight bulging or erosion at region 200 of spray cooled inner steel plate 38 (or 138).

Figure 6A:
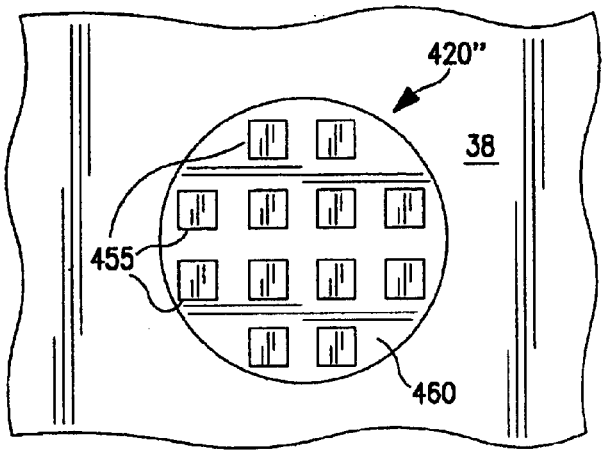
Figure 6:
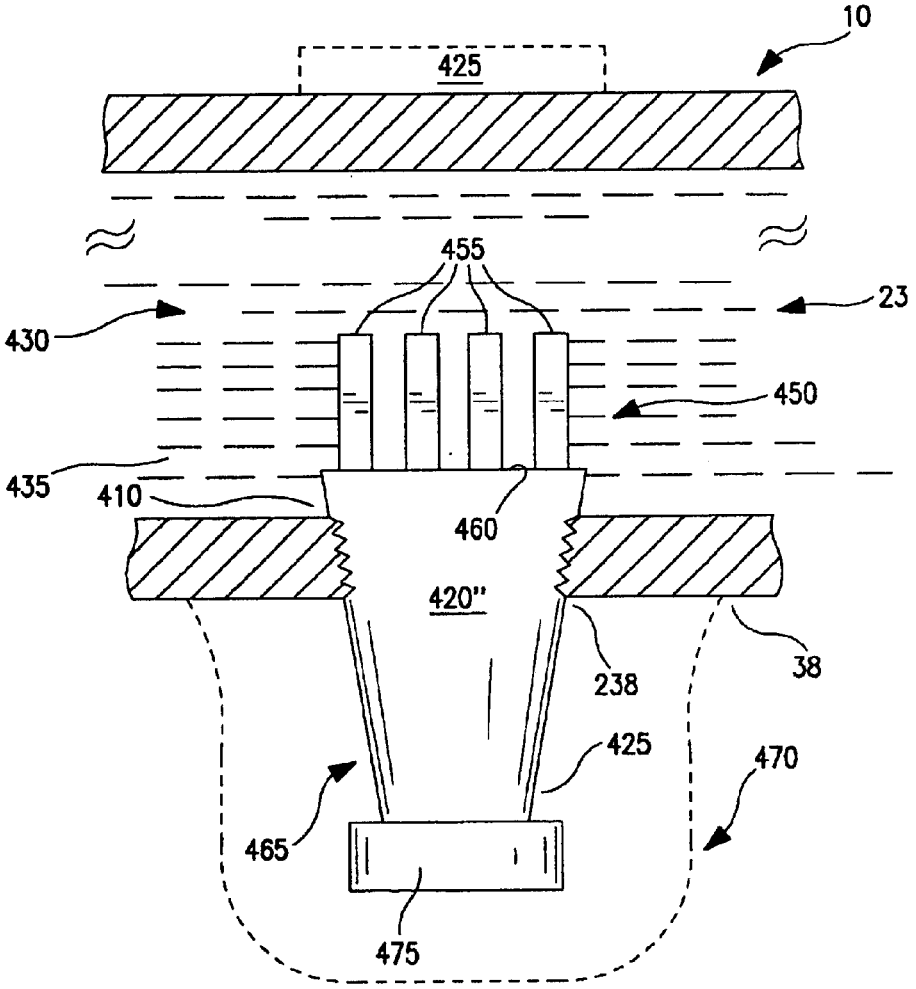

This "bulging" or erosion of the plate would indicate a high thermal stress location, which at times can be predicted on the basis of experience furnace type and operation with reference to FIG. 6 pre-formed openings 410 are provided at this location in steel plate 38 (138) to receive inserts 420 in accordance with this invention water-cooled inner plates 38 (or 138) are essentially continuous integral carbon steel plate structures which are formed by welding together separate steel plate shapes, using conventional carbon steel welding techniques, such as electrode or MIG techniques, which are well known and are easily utilized to produce continuous steel plates such as the spray cooled frusto-conical inner roof plate 38 and cylindrical, spray cooled furnace inner side wall plate 138. The inner plates are typically made of carbon steel ⅜ to ⅝ inch in thickness and are commonly several feet in width and several yards in length and formed to a desired cover configuration or furnace shell radius.

Figure 4:
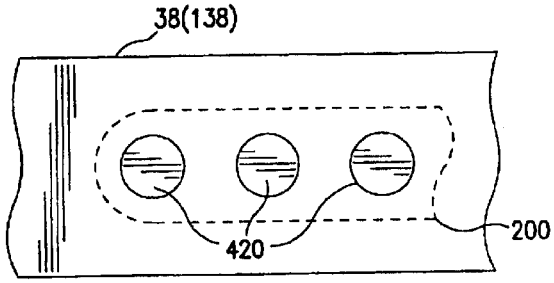
FIG. 4 is a partial elevation view taken in a direction perpendicular to the inner plate of the furnace roof shown in FIG. 2*a* schematically illustrating a high thermal stress region and the incorporation of thermally conductive, slag retaining inserts of the present invention in the region.

In the practice of the present invention, with reference to FIGS. 2*a*, 4 and 5 et seq., thermally conductive slag retaining inserts 420–420"" are installed to protrude out both sides of inner plate 38 in the high heat load region 200. The high surface area of protrusion 450 into water containing chamber 430 enables efficient heat transfer from elongate inserts 420–420"" allowing the inserts to remain relatively cold. The relatively cold protrusion 465 into the furnace provides a relatively cold surface to freeze contacting slag and mechanical means to retain the slag as shown at 470. The engagement of the elongate inserts 420–420"" with inner plate should be essentially water tight. The elongate inserts 420–420"" are easily installed and easily removed for inspection and replacement.

With reference to FIG. 5, 5*a*, the metal slag retention means 420' of the present invention comprises an elongate, pre-formed metal insert 425 suitably frusto-conical in form, which extends from exterior the hot surface 38 of the water-cooled closure element of roof 10 through pre-formed opening 238 into the water containing chamber 430 of the closure element of roof 10, the cooling water being schematically indicated at 435 and being provided as a spray of fine droplets from spray nozzles 34, shown in FIGS. 2*a* and 3*a*, or as a stream, or pool of water, directly from header 29 by way of valve 440. A water tight forced interference fit is established at 410. At the terminal portion 450 of elongate insert 425, which is exposed to water 435, inside of the water containing chamber 430, a plurality of spaced apart metal extensions, e.g. fins 455, are provided, which are preferably integral with the terminal surface 460 of elongate metal insert 425. The fins 455, terminal surface 460 and the portion of elongate exposed to water are cooled by contact with the surrounding water spray, stream or pool 435 and heat developed in the opposite terminal portion 455 of slag retention insert means 420' from furnace 12, is rapidly dissipated with the resulting cooling of insert means 420' and the increased deposit and adherence of protective slag build-up 470. At the opposite terminal portion 465 of elongate metal insert 425 which is exterior water containing chamber 430 and extends into and is exposed to slag developed in furnace 12*a* transverse outward disc-shaped extension 475 is provided which acts to facilitate retention of an increased quantity of slag which serves to protect the adjacent region of surface 38. Extension 475 can have other shapes eg. flange, spoked cupped, and the like for slag retention.

With reference to FIG. 6, 6*a*, the embodiment shown therein is identical to that of FIG. 5, 5*a* except that the water tight seal 410 is a threaded connection at pre-formed opening 238.

Figure 7A:
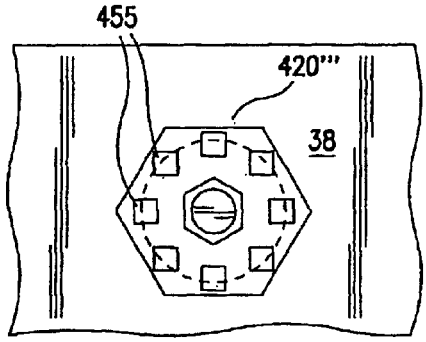
Figure 7:
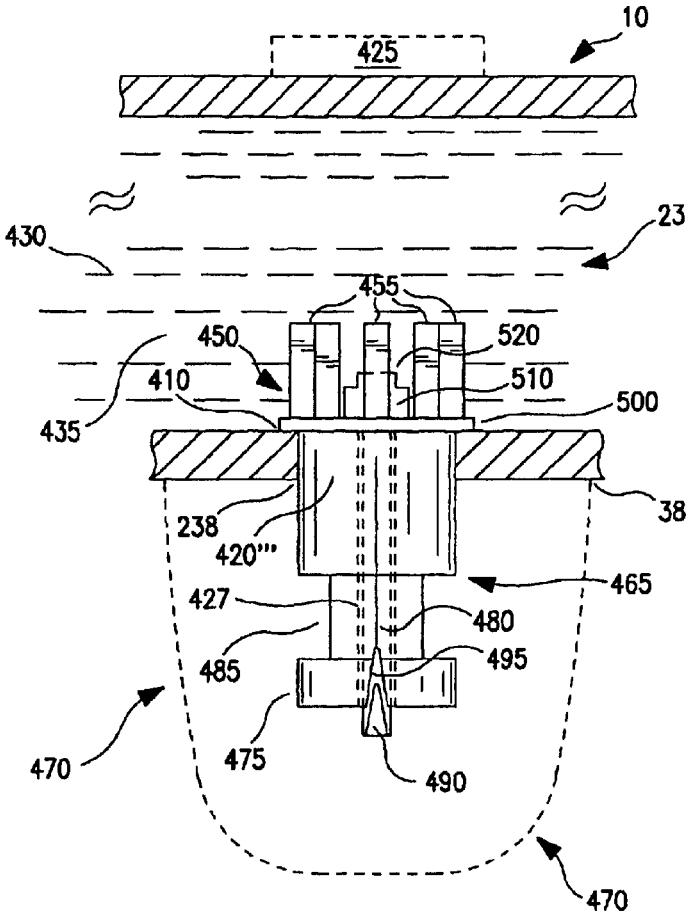
Figure 7B:
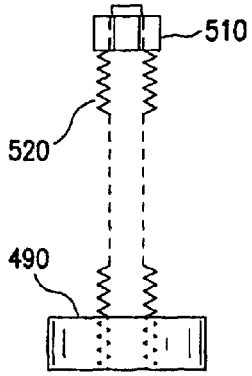

With reference to FIG. 7, 7*a*, 7*b*, the embodiment shown the ein comprises a cylindrically shaped elongate metal insert 420"" slidably engaged with water-cooled metal plate 38 at pre-formed opening 238 and having an attached shoulder element 500 which rests on metal plate 38 inside water containing chamber 430. A substantially water tight seal 410 is established by adjusting threaded nut 510 on threaded shaft 520 which passes through elongate metal insert 420"" via bore 427 and terminates in wedge 490. Wedge 490 is seated in groove 495 of elongate metal insert 420"" which communicates with split 480 in insert 420"". Upon tightening of nut 510 the wedge 490 advances into and widens split 480 causing insert 420"" to bear against plate 38 and provide a water tight seal. The narrow section 485 of insert 420"" aids in the retention of slag in cooperation with disc-shaped element 475.

Figure 8A:
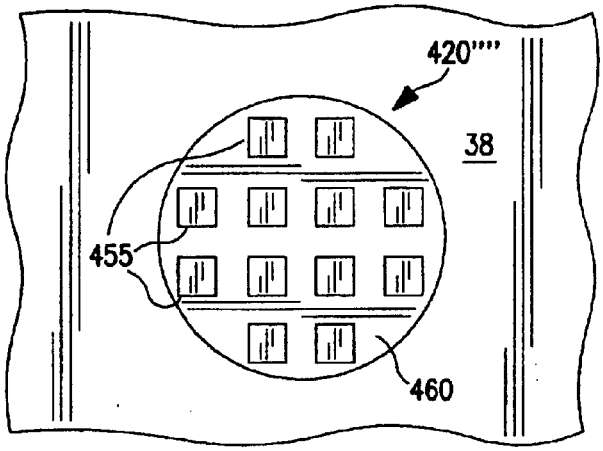
Figure 8:
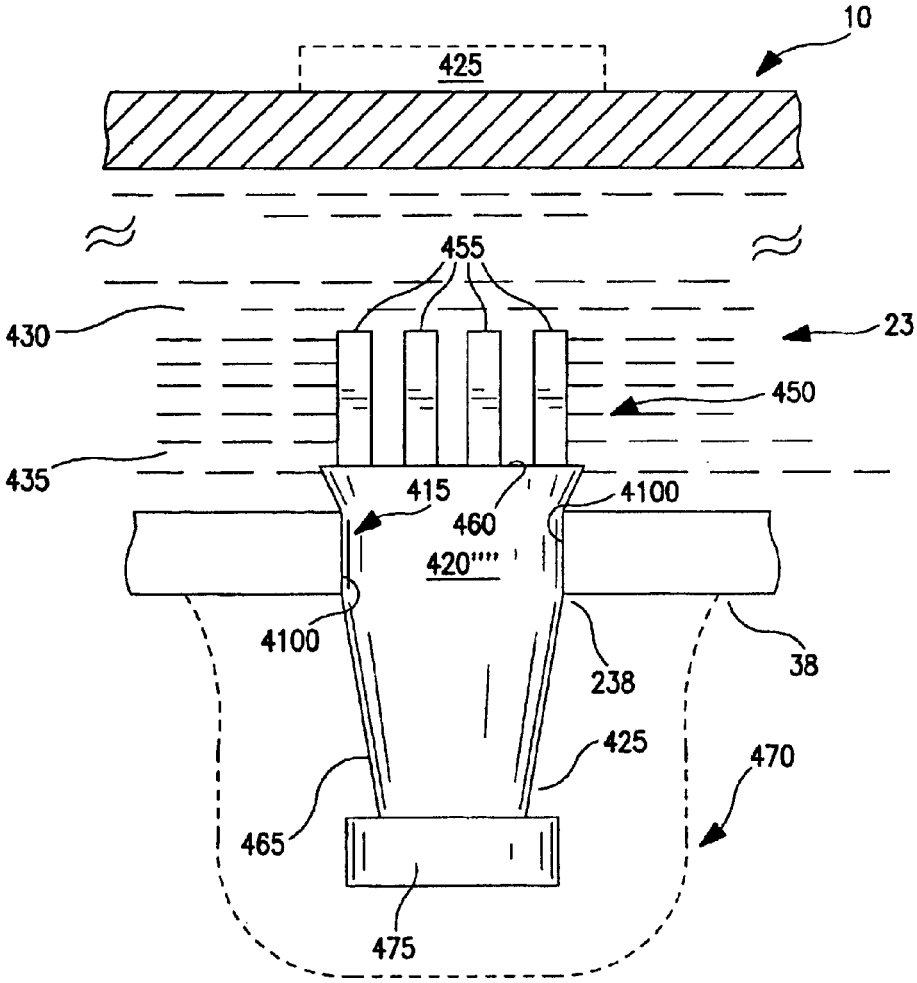

The embodiment of FIG. 8, 8*a* is identical to that of FIG. 5, 5*a* except that elongate metal insert 420"" is provided with an intermediate portion 415 of uniform diameter between its first and second terminal portions 459, 465. The diameter of intermediate portion 415 is slightly larger than the initial diameter of pre-formed opening 238 in metal plate 38. Metal plate 38 is heated in the vicinity of pre-formed opening 138 to expand its diameter to receive intermediate portion 415 after which plate 38 is allowed to cool and a substantially water tight compression fit is established at 4100.

Figure 9A:
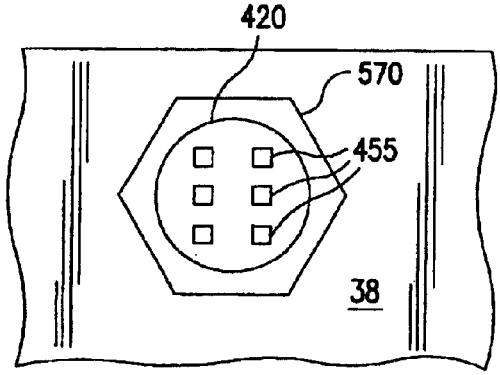
Figure 9:
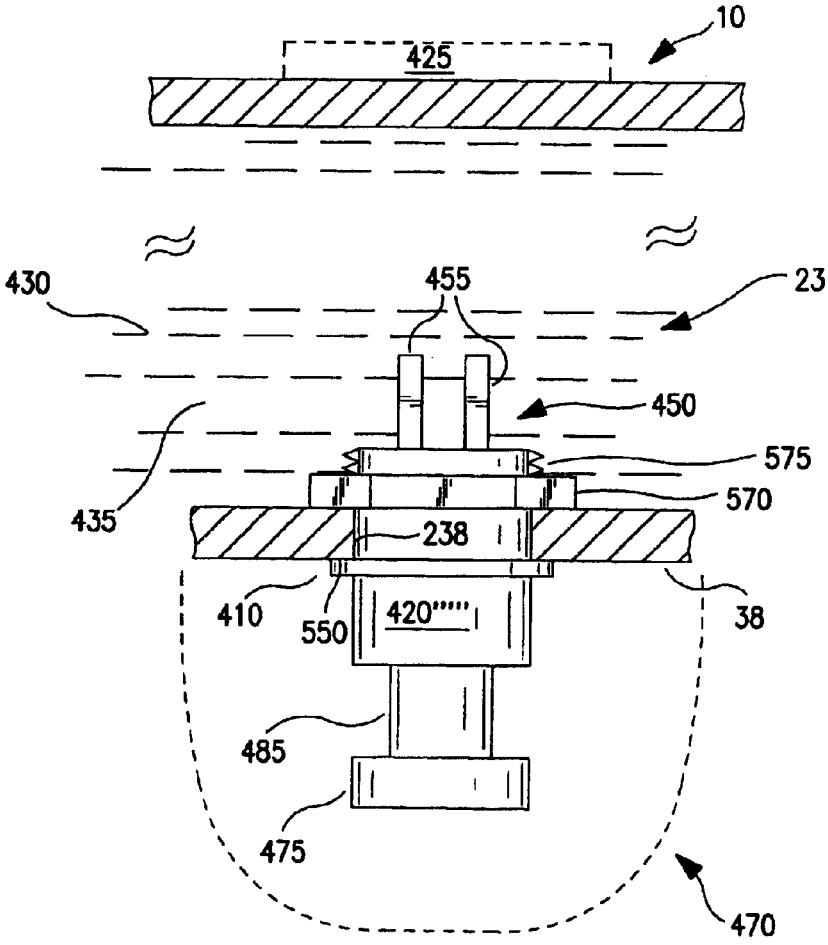

With reference to FIG. 9, 9*a*, the embodiment shown therein comprises a cylindrically shaped elongate metal insert 420"" slidably engaged with water-cooled steel plate 38 at pre-formed opening 238 and having an attached shoulder element 550 which abuts plate 38 outside water containing chamber 430 in the furnace system. A water tight seal 410 is established by adjusting threaded nut 570 on threaded portion 575 of elongate metal insert 420"" located inside water containing chamber 430, to cause shoulder element 550 to bear against metal plate 38. The narrow section 485 of insert 420"" aids in the retention of slag in cooperation with disc-shaped element 475.

The slag retention devices of the present invention are readily installed through inspection plates 425 or from the furnace side during routine maintenance or during assembly of the furnace closure elements. It is preferred that the elongate metal insert 420–420"" be an integral device, i.e., formed by machining the insert from a single metal body, including the fins and disc-shaped slag retainer element. The fins can be of other than rectangular cross section e.g. circular, blade shaped and the like. The first and second terminal portions, fins and disc-shaped slag retainer element are all in a heat transfer relationship so that a temperature gradient in the elongate metal insert will result in efficient transfer of heat from the higher temperature location to the lower, with lowering of the higher temperature in the second terminal portion, as heat is dissipated from the lower temperature location by cooling water in contact with the first terminal portion. The relatively cold second terminal freezes more slag, resulting in a thicker slag layer which protects the second terminal portion and reduces the heat load on the adjacent furnace component.

An important feature of the present invention is that the elongate metal insert extend through furnace wall into the cooling water enclosure, and into the furnace so that heat developed in the portion directly exposed to the heat of the furnace is efficiently dissipated from the portion exposed to cooling water. To obtain optimum results, the outer surface area of the portion exposed to the cooling water is from about 17% and 80% of the total of the outer surface area of the portion exposed to cooling water and the outer surface area of the portion directly exposed to the heat of the furnace. There are various ways to determine the above noted relationship. One method is hereinafter described in the following example with reference to FIG. 10, 10*a* which shows the slag retention device of FIG. 5, 5*a*.

For the purposes of example only, the following hypothetical dimensions are used:

| | |
|---|---|
| rA-1 | 1.0 |
| rA-3 | 0.941 |
| rA-4 | 0.8528 |
| rA-5 | 0.8084 |
| rA-6 | 0.5584 |
| L-1 | 1.0 |
| L-2 | 0.25 |
| L-3 | 1.6667 |
| L-4 | 0.5 |
| D | 0.25 |
| N | 12 |

Figure 10A:
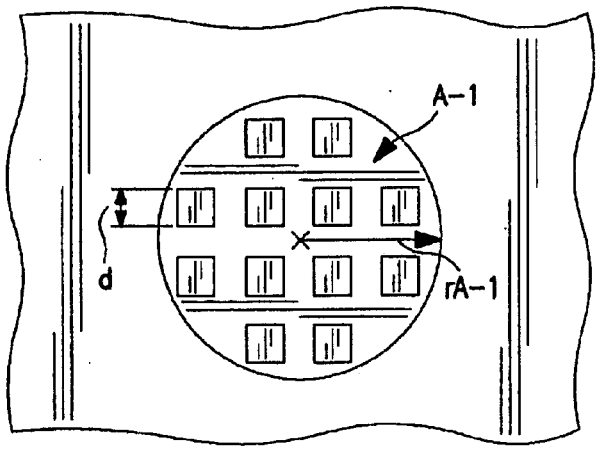
FIG. 10 corresponds to the device of FIG. 5 and is dimensioned to illustrate the calculation of surface area of the device.
Figure 10:
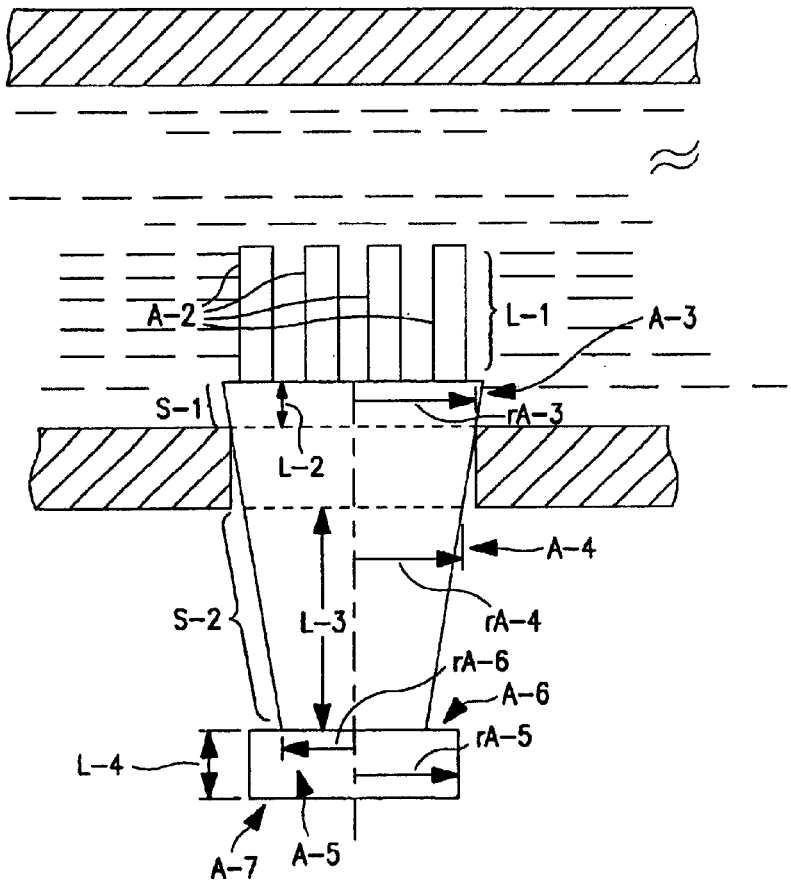

With reference to FIG. 10, the surface area of the first terminal portion of elongate metal insert 420' is: A-1+A-2+A-3 and the surface area of the second terminal portion is: A-4+A-5+A-6, A-7.

The % of the area of the first terminal portion (exposed to cooling water) is given by the expression:

$$\frac{A\text{-}1 + A\text{-}2 + A\text{-}3}{A\text{-}1 + A\text{-}2 + A\text{-}3 + A\text{-}4 + A\text{-}5 + A\text{-}6 + A\text{-}7} \times 100$$

| AREA | FORMULA | VALUE-in$^2$ |
|---|---|---|
| A-1 | $\Pi(rA\text{-}1)^2$ | 3.1415 |
| A-2 | (L-1) + (L*4*n) | 12.0 |
| A-3 | $\Pi(s\text{-}1)[(rA\text{-}1) + (rA\text{-}B)]$ <br> $s\text{-}1 = ([rA\text{-}1) - (rA\text{-}3)]^2 + (L\text{-}2)^2)^{1/2}$ | 1.5663 |
| A-4 | $\Pi(s\text{-}2)[(rA\text{-}4) + (rA\text{-}6)]$ <br> $s\text{-}2 = ([rA\text{-}4) - (rA\text{-}6)]^2 + (L\text{-}3)^2)^{1/2}$ | 7.5033 |
| A-5 | $2\Pi(rA\text{-}5) * (L\text{-}4)$ | 2.5395 |
| A-6 | $\Pi[(rA\text{-}5)^2 - (rA\text{-}6)^2]$ | 1.0734 |
| A-7 | $\Pi(rA\text{-}5)^2$ | 2.0528 |

First terminal portion, AT1=A-1+A-2+A-3=16.7078 in$^2$.

Second terminal portion, AT2=A-4+A-5+A-6+A-7=13.1690 in$^2$.

$$\%\ FTP = \frac{16.7078}{16.7078 + 13.169} = 55.92\%$$

$$\%\ STP = \frac{13.169}{16.7078 + 13.169} = 44.08\%$$

Formulas for determination of area of frusto-conical surfaces are published in "Machinery's Handbook, 23$^{rd}$ Edition, Industrial Press Inc., New York".

What is claimed is:

1. Slag retention means for cooling and retaining slag adjacent water-cooled metal plate of a water containing closure element of a furnace adapted to contain molten material including slag, said water-cooled metal plate being spaced from a body of molten material in the furnace but exposed to high temperature thermal energy, said slag retention means comprising an elongate, metal insert having first and second adjoining terminal portions in a heat transfer relationship, said first terminal portion extending from a substantially water tight engagement at a pre-formed opening in said water-cooled metal plate to inside said water containing closure element for contact with water therein and for cooling of both the first and second adjoining terminal portions; said second terminal portion extending inside the furnace away from said water-cooled plate for contact with and improved retention of solidified slag due to cooling of said second terminal portion.

2. Slag retention means in accordance with claim 1 wherein a plurality of spaced apart metal extensions are provided at said first terminal portion of said elongate metal insert for contacting water inside said water containing closure element.

3. Slag retention means in accordance with claim 1 wherein the first terminal portion is engaged with said water-cooled metal plate in a forced, interference fit.

4. Slag retention means in accordance with claim 1 wherein the first terminal portion is engaged with said water-cooled metal plate by a threaded connection.

5. Slag retention means in accordance with claim 1 wherein the first terminal portion is slidably engaged with said water-cooled metal plate and is provided with a transverse shoulder element which rests on said plate by a threaded nut engaging a threaded shaft extending from said first terminal portion, said threaded shaft being coupled to said elongate, metal insert at its second terminal portion by means of a wedge and groove coupling.

6. Slag retention means in accordance with claim 1 wherein a transverse, metal outwardly extending member is provided at the second terminal portion of said elongate metal insert inside the furnace system for contact with and retention of slag.

7. Slag retention means in accordance with claim 1 wherein said elongate metal insert is provided with a cylindrically shaped intermediate portion between the first and second terminal portions having a uniform diameter slightly larger than an initial diameter of the pre-formed opening in said metal plate, said intermediate portion being inserted into the pre-formed opening after heat expansion thereof to establish a compression fit between said intermediate portion and said metal plate upon cooling of said metal plate.

8. Slag retaining means in accordance with claim 1 wherein the first terminal portion is slidably engaged with said metal plate and is provided with a transverse shoulder element which abuts said metal plate outside said water containing closure element and is drawn tight against said plate by a threaded nut engaging a threaded section of the first terminal portion inside said water containing closure element.

9. Slag retention means in accordance with claim 1 which is formed of a metal selected from copper, copper base alloys, aluminum, aluminum base alloys and steel.

10. Slag retention means in accordance with claim 1 wherein the surface area of the first terminal portion of the elongate metal insert is from about 17% to 80% of the total surface area of first and second terminal portions.

11. A water-cooled furnace containing molten material and slag having a water containing closure element which includes a water-cooled metal plate in combination with slag retention means for cooling and retaining slag, said slag retaining means comprising an elongate, metal insert having first and second adjoining terminal portions in a heat transfer relationship, said first terminal portion extending from a substantially water tight engagement at a pre-formed opening in said water-cooled steel plate to inside said water containing closure element for contact with water therein and for cooling of both the first and second adjoining terminal portions; said second terminal portion extending inside the furnace away from said water-cooled plate for contact with and retention of solidified slag.

* * * * *